US005895163A

United States Patent [19]

Chapman

[11] Patent Number: 5,895,163

[45] Date of Patent: Apr. 20, 1999

[54] SOAPING BODY RUB APPARATUS

[76] Inventor: Lance Chapman, 270L Rimview Dr., Colorado Springs, Colo. 80919

[21] Appl. No.: 08/939,390

[22] Filed: Sep. 29, 1997

[51] Int. Cl.[6] ..... A47K 5/04; A47K 5/08; A47K 7/00

[52] U.S. Cl. ..... 401/201; 401/8; 383/117

[58] Field of Search ..... 401/201, 8; 383/117

[56] References Cited

U.S. PATENT DOCUMENTS

| | | | |
|---|---|---|---|
| 1,351,311 | 8/1920 | Virneberg | 401/201 X |
| 1,978,169 | 10/1934 | Ricketts | 401/201 |
| 2,160,921 | 6/1939 | Stroop | 401/201 |
| 2,958,885 | 11/1960 | Donney | 401/201 X |
| 3,977,452 | 8/1976 | Wright | 401/201 X |
| 4,228,834 | 10/1980 | Desnick | 401/201 X |
| 5,031,759 | 7/1991 | Ogilvie | 401/201 X |
| 5,219,340 | 6/1993 | Seneca | 604/290 |

FOREIGN PATENT DOCUMENTS

| | | | |
|---|---|---|---|
| 42864 | 1/1966 | German Dem. Rep. | 401/201 |

*Primary Examiner*—Steven A. Bratlie
*Attorney, Agent, or Firm*—G. F. Gallinger

[57] ABSTRACT

A soap dispensing body rub apparatus which is both effective and inexpensive to fabricate is disclosed. One aspect of the invention comprises: a long strip of plastic mesh rolled to a larger circumference forming a large roll, the large roll having an opening therethrough, the mesh sealed therearound; a shorter strip of plastic mesh, similar in width to the long strip, rolled to a smaller circumference forming a small roll; wherein the small roll is positioned with its opposite side edges co-terminating with the large roll so that it covers the opening in the large roll; and wherein both rolls are flattened with the small roll covering the opening, and the opposite edges of both rolls seamingly fused together; so when the large roll is turned inside out with the small flattened roll covering the opening, the bar of soap may be inserted under the covered opening into the large roll.

9 Claims, 1 Drawing Sheet

SOAPING BODY RUB APPARATUS

FIELD OF INVENTION

This invention relates to brushes, sponges, and pads used to rub the body. More particularly, this invention relates to a soap dispensing body rub apparatus which is both effective and inexpensive to fabricate.

BACKGROUND OF THE INVENTION

There is a need and demand for time saving and convenient items for cleaning. The concept of dispensing soap as needed while rubbing has been popularized in an apparatus for cleaning dishes comprising a sponge and liquid detergent container.

What is needed is a comparable body soap dispensing apparatus. Particularly an apparatus which can be fabricated to accommodate individual preferences for varying degrees of abrasiveness.

OBJECTS AND STATEMENT OF INVENTION

It is an object of this invention to disclose a body rub apparatus which dispenses soap while being used to rub the body. It is an object of this invention to disclose an apparatus which may be fabricated to suit individual preferences for coarseness and resulting abrasiveness. It is yet a further object of this invention to disclose a design for a body rub apparatus which provides a courser surface for selective use on difficult to remove or dirty areas of the body. It is yet a further object of this invention to disclose a design for a body rub apparatus which eliminates the need for a soap dish and which is conducive to manufacture in a range of bathroom decor colors. It is a final object of this invention to disclose a body rub apparatus design which produces an unusually durable and effective rubbing apparatus which is unexpectedly inexpensive to manufacture.

One aspect of this invention provides for a soaping body rub apparatus for use with a bar of soap comprising: a long strip of plastic mesh rolled to a larger circumference forming a large roll, said large roll having an opening therethrough, said mesh sealed therearound: a shorter strip of plastic mesh, similar in width to the long strip, rolled to a smaller circumference forming a small roll; wherein said small roll is positioned with its opposite side edges co-terminating with the large roll so that it covers the opening in the large roll; and wherein both rolls are flattened with the small roll covering the opening, and the opposite edges of both rolls seamingly fused together; so when the large roll is turned inside out with the small flattened roll covering the opening, the bar of soap may be inserted under the covered opening into the large roll.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
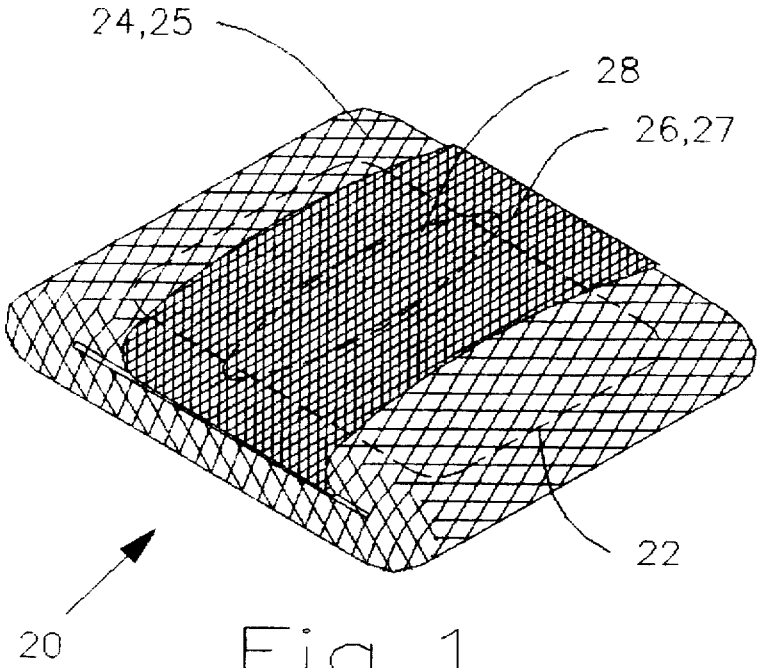
FIG. 1 is a perspective view of a soaping body rub apparatus.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
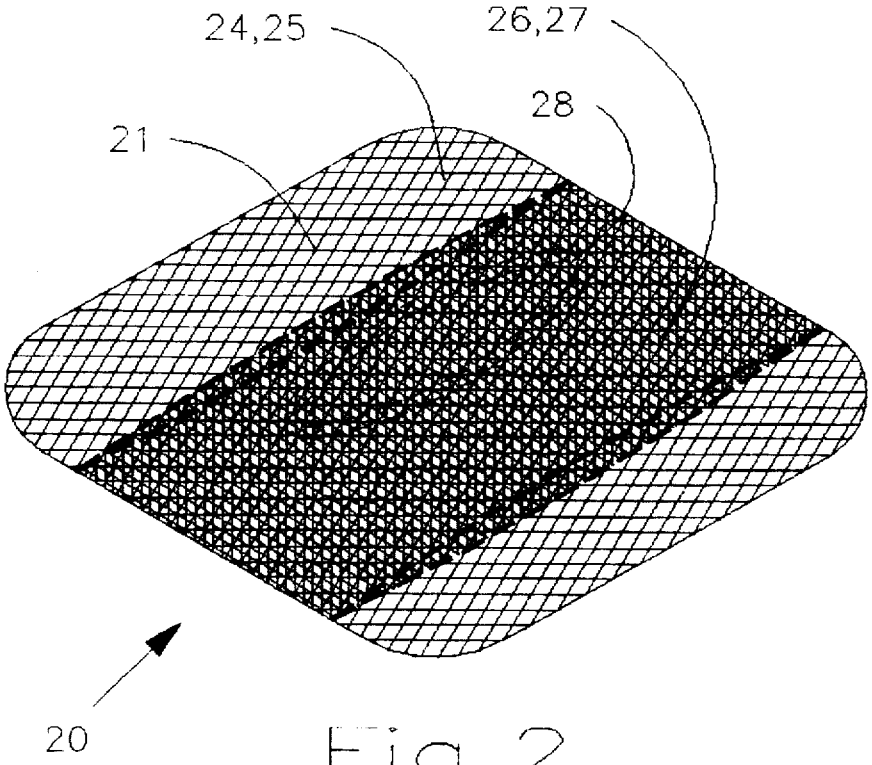
FIG. 2 is a perspective view of the apparatus shown in FIG. 1 in an inside out position, this position showing the construction thereof.

Turning now to the drawings and more particularly to FIG. 1 we have a perspective view of a soaping body rub apparatus 20. FIG. 2 is a perspective view of the apparatus shown in FIG. 1 in an inside out position, this position showing the construction thereof.

The soaping body rub apparatus 20 for use with a bar of soap 22 comprises: a long strip 24 of plastic mesh rolled to a larger circumference forming a large roll 25, said large roll 25 having an opening 28 therethrough, said large roll 25 of mesh sealed therearound and a shorter strip 26 of plastic mesh, similar in width to the long strip 24, rolled to a smaller circumference forming a small roll 27. Said small roll 27 is next positioned with its opposite side edges co-terminating with the large roll 25 so that it covers the opening 28 in the large roll 25. Next both rolls 25,27 are flattened with the small roll 27 covering the opening 28. Then the opposite edges of both rolls 25,27 are seamingly fused together. When the large roll 25 is turned inside out with the small flattened roll 27 covering the opening 28, the bar of soap 22 may then be inserted under the covered opening 28 into the large roll 25.

Most preferably the opening 28 is a lateral cut centrally positioned on the flattened roll 25. The type of plastic mesh used is selected by its coarseness and the degree of abrasion on wishes the apparatus to have. It has been found that when the mesh 21 comprises parallel rows which are sealingly crossed and connected to other parallel rows results are satisfactory. If each row in the mesh 21 comprises a narrow strip of plastic the apparatus 20 is more abrasive. When the plastic mesh 21 comprises woven strips of plastic the apparatus 20 is even yet more abrasive. If the shorter strip 26 is more abrasive than the long strip 24 then the resulting apparatus 20 may, in addition to being used for general cleaning of the body, may be used for rubbing and cleaning especially dirty or hard to remove areas on the body.

It has been found that if the long roll 25 comprises multiple layers of mesh 21 so that its inner to outer thickness is generally in excess of 1/16 inches the individual has an adequate rubbing thickness.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A soaping body rub apparatus for use with a bar of soap comprising:

a long strip of plastic mesh rolled to a larger circumference forming a large roll, said large roll having an opening therethrough, said mesh sealed therearound;

a shorter strip of plastic mesh, similar in width to the long strip, rolled to a smaller circumference forming a small roll;

wherein said small roll is positioned with its opposite side edges co-terminating with the large roll so that it has an outside portion and covers the opening in the large roll;

and wherein both rolls are flattened with the small roll covering the opening, and the opposite edges of both rolls seamingly fused together;

so when the large roll is turned inside out with the small flattened roll covering the opening, the bar of soap may be inserted under the small roll through the opening into the large roll, and then one may rub themselves with the outside portion of the small roll and any circumferential portion of the large roll not covered by the small roll.

2. An apparatus as in claim 1 wherein the opening is a lateral cut centrally positioned on the large flattened roll.

3. An apparatus as in claim 2 wherein the mesh comprises parallel rows which are sealingly crossed and connected to other parallel rows.

4. An apparatus as in claim 3 wherein each row comprises a narrow strip of plastic.

5. An apparatus as in claim 1 wherein in the plastic mesh comprises woven strips.

6. An apparatus as in claim 1 wherein the long strip has a different abrasiveness when used for rubbing than the shorter strip.

7. An apparatus as in claim 6 wherein the shorter strip is more abrasive than the long strip.

8. An apparatus as in claim 1 wherein the long roll comprises multiple layers of mesh so that its inner to outer thickness is generally in excess of 1/16 inches.

9. An apparatus as in claim 8 wherein the plastic mesh comprises parallel rows which are sealingly crossed and connected to other parallel rows.

* * * * *